US006143146A

United States Patent [19]

Strom

[11] Patent Number: 6,143,146

[45] Date of Patent: Nov. 7, 2000

[54] FILTER SYSTEM

[76] Inventor: Doug Strom, 2302 Avenue "I", Scottsbluff, Nebr. 69361

[21] Appl. No.: 09/139,829

[22] Filed: Aug. 25, 1998

[51] Int. Cl.[7] ..... C25B 9/00; C25B 11/00

[52] U.S. Cl. ..... 204/269; 204/276; 204/284; 204/287

[58] Field of Search ..... 204/275, 276, 204/284, 269, 287, 271; 205/742, 751

[56] References Cited

U.S. PATENT DOCUMENTS

| | | | |
|---|---|---|---|
| 3,616,356 | 10/1971 | Roy | 205/751 X |
| 3,928,146 | 12/1975 | Russell | 204/14 |
| 4,051,009 | 9/1977 | Schweickart et al. | 204/279 |
| 4,096,032 | 6/1978 | Mayers et al. | 176/38 |
| 4,157,942 | 6/1979 | Tuznik et al. | 204/35 |
| 4,187,166 | 2/1980 | Kruper | 204/43 |
| 4,197,167 | 4/1980 | Wright, Jr. | 204/40 |
| 4,197,181 | 4/1980 | Portal et al. | 204/287 X |
| 4,221,670 | 9/1980 | Ziemek | 210/474 |
| 4,238,314 | 12/1980 | Ueno | 204/52 |
| 4,399,020 | 8/1983 | Branchick et al. | 204/269 |
| 4,445,984 | 5/1984 | Tison | 204/49 |
| 4,569,756 | 2/1986 | Klein | 210/193 |
| 4,789,450 | 12/1988 | Paterson | 204/287 X |
| 5,080,806 | 1/1992 | Balzano | 210/730 |
| 5,192,418 | 3/1993 | Hughes et al. | 205/100 |
| 5,262,062 | 11/1993 | Gabbita | 210/710 |
| 5,324,396 | 6/1994 | Ferron et al. | 204/284 X |
| 5,804,055 | 9/1998 | Coin et al. | 204/269 X |

*Primary Examiner*—Donald R. Valentine
*Attorney, Agent, or Firm*—Zarley, McKee, Thomte, Voorhees & Sease; Dennis L. Thomte

[57] ABSTRACT

A filter system includes a tank for holding waste water with an inlet port for receiving waste water from an electroplating process, and an outlet port for dispensing filtered water back to the electroplating process. A plurality of anode elements and cathode elements are arranged within the tank in a repeating pattern of anode and cathode from one end of the tank to the other. The anode elements are formed of a mesh sheet of electrically conductive material, and the cathode elements include a pair of electrically conductive mesh sheets which are mounted to a frame to form a box. Each cathode box is filled with electrically conductive shavings, to increase the surface area for removing heavy metals from the waste water. The anodes and cathodes are removably slidably received within the tank, and are electrically connected to a DC power supply, the anodes connected to the positive terminal and the cathodes connected to the negative terminal.

9 Claims, 5 Drawing Sheets

FILTER SYSTEM

TECHNICAL FIELD

The present invention relates generally to apparatus for filtering waste metals, such as nickel and zinc, from waste water from the electroplating process, and more particularly to an improved filter which removes sufficient particulate that the rinse water may be recycled for additional use in the electroplating process.

BACKGROUND OF THE INVENTION

In the electroplating process, a metal plate is electrodeposited onto a work piece by immersing the work piece into an aqueous bath having a concentrated ionic metal species dissolved therein and cathodically biasing the work piece to reduce and plate the metal. The plated work piece is removed from the bath and cleansed with clean water to rinse away residual plating solution dragged out with it. This rinse water becomes increasingly contaminated by low concentrations of the particular plating materials utilized during the electroplating process.

The accumulation of metal ions in processed water utilized in the field of electroplating and etching procedures requires treatment of waste water prior to disposal in the environment. While various methods of recovering metal ions from processed water have been utilized in the prior art, they typically suffer from one of two major problems: (1) great expense involved in the equipment utilized in the process, or (2) a relatively low efficiency in removing metal ions from the waste water.

SUMMARY OF THE INVENTION

It is therefore a general object of the present invention to provide an improved apparatus for filtering waste water from the electroplating process.

Another object is to provide a filter apparatus which is inexpensive to manufacture and operate.

Still another object of the present invention is to provide a filter for treating electroplating waste water which is highly efficient in removing metal ions from the water.

These and other objects will be apparent to those skilled in the art.

The filter system of the present invention includes a tank for holding waste water with an inlet port for receiving waste water from an electroplating process, and an outlet port for dispensing filtered water back to the electroplating process. A plurality of anode elements and cathode elements are arranged within the tank in a repeating pattern of anode and cathode from one end of the tank to the other. The anode elements are formed of a mesh sheet of electrically conductive material, and the cathode elements include a pair of electrically conductive mesh sheets which are mounted to a frame to form a box. Each cathode box is filled with electrically conductive shavings, preferably waste shavings, to increase the surface area for removing heavy metals from the waste water. The anodes and cathodes are removably slidably received within the tank, and are electrically connected to a DC power supply, the anodes connected to the positive terminal and the cathodes connected to the negative terminal.

DESCRIPTION OF THE PREFERRED EMBODIMENT

Figure 1:
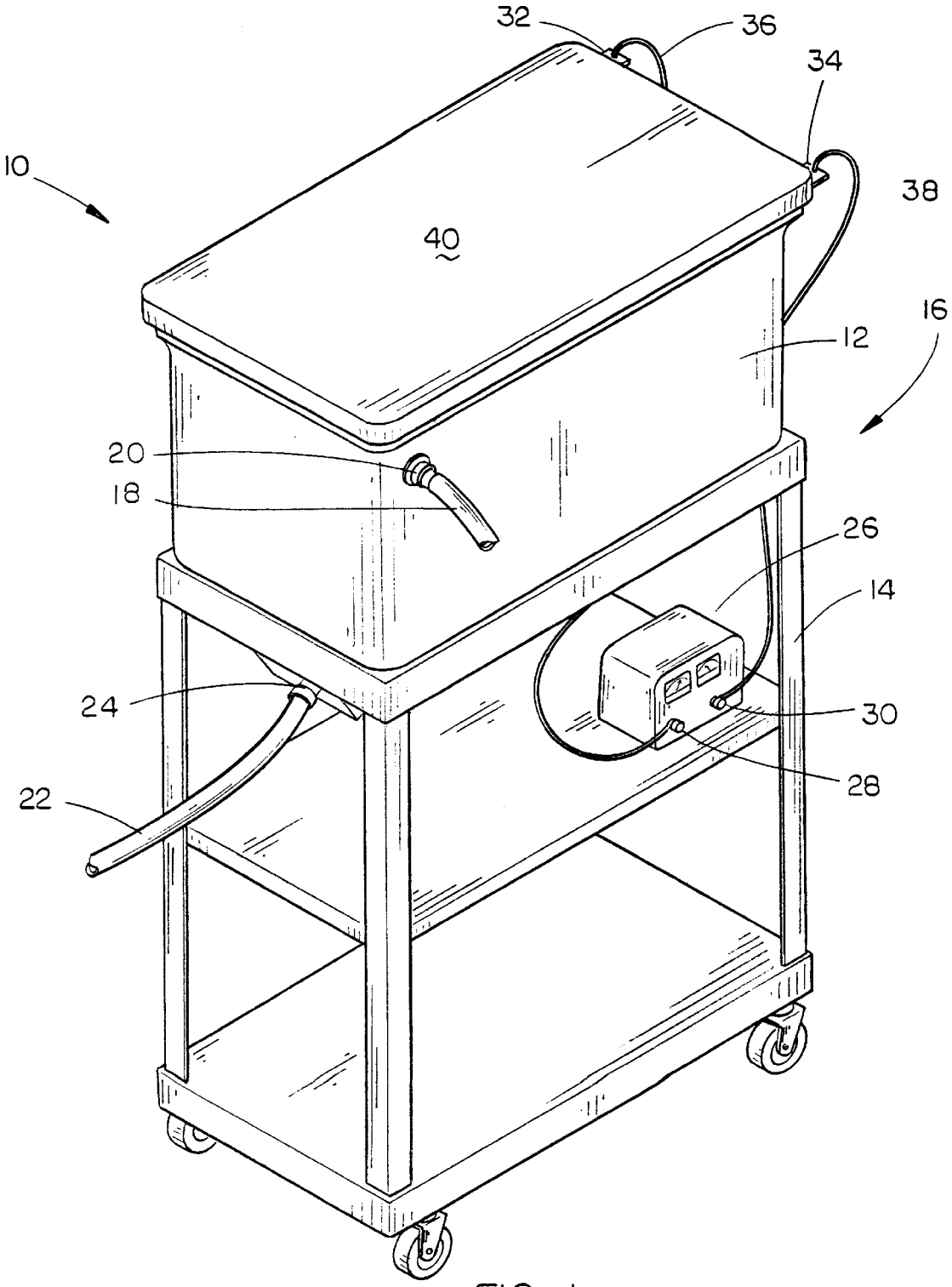
FIG. 1 is a perspective view of the filter system mounted in a tank, and supported on a portable cart to form a recovery system.

Referring now to the drawings, in which similar or corresponding parts are identified with the same reference numeral and more particularly to FIG. 1, the filter system of the present invention is designated generally at 10 and is shown installed in a tank 12 which is supported on a portable cart 14 to form a recovery system designated generally at 16.

Recovery system 16 includes an inlet conduit 18 which will direct waste rinse water from the electroplating process to an inlet port 20 in tank 12. An outlet conduit 22 is connected to an outlet port 24 in tank 12, and directs the filtered water back to the electroplating system for reuse as rinse water.

Cart 14 is provided to permit convenient portability of recovery system 16. A direct current power supply is shown generally at 26 and includes positive and negative terminals 28 and 30 electrically connected to positive and negative conductor strips 32 and 34 projecting from tank 12, by electrical leads 36 and 38 respectively.

Figure 2:
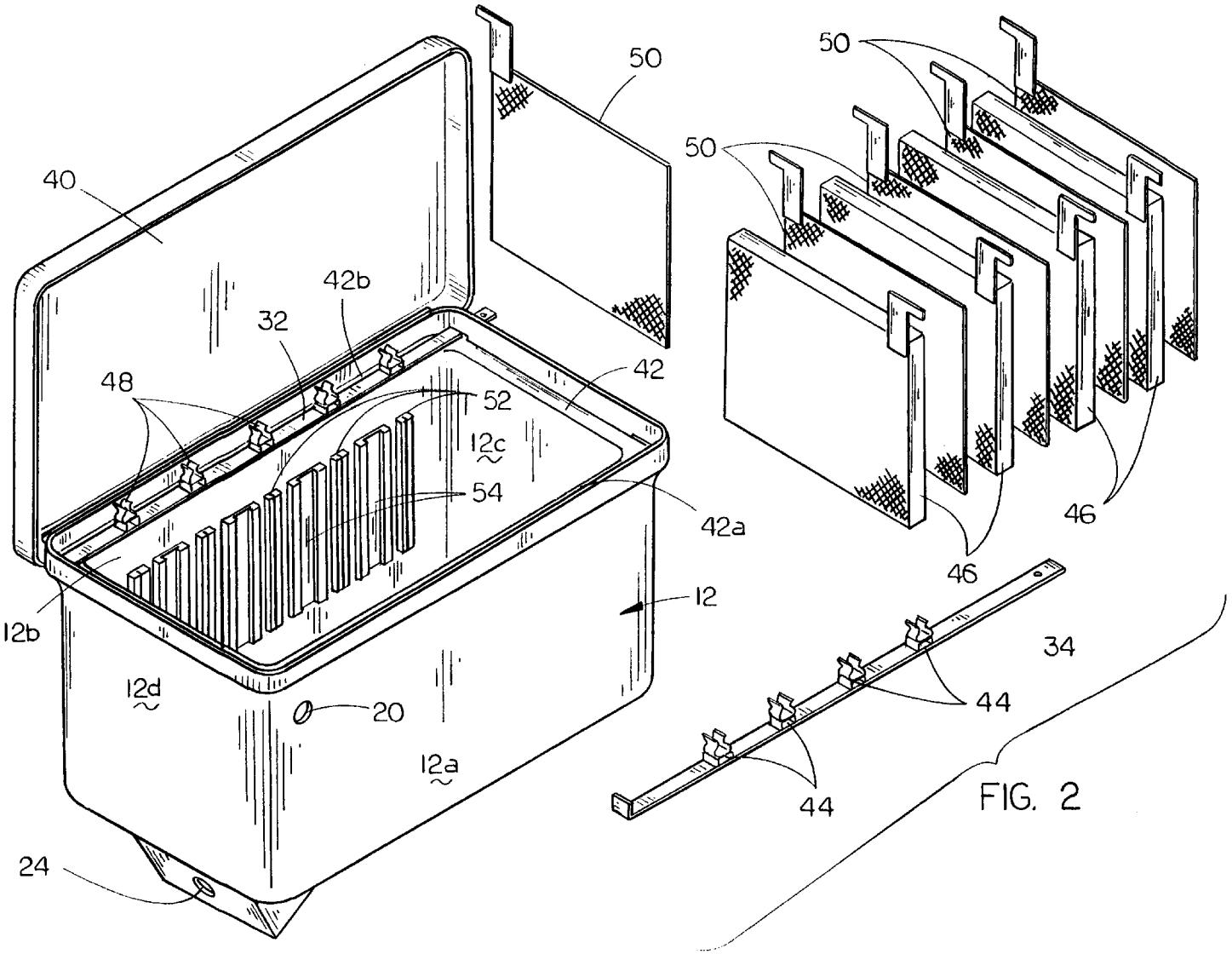
FIG. 2 is an exploded perspective view of the tank, with the anodes and cathodes removed from the tank.

Referring now to FIG. 2, tank 12 is an open topped container having a forward wall 12*a*, rearward wall 12*b*, opposing end walls 12*c* and 12*d* and a bottom 12*e* (not seen in FIG. 2). A lid 40 is hinged along a rearward edge to selectively cover and close the open upper end of tank 12.

A shoulder 42 is formed along the upper edges of walls 12*a*, 12*b*, 12*c*, and 12*d* of tank 12, the forward shoulder 42*a* formed of forward wall 12*a* supporting elongated conductor strip 34, and rearward shoulder 42*b* supporting conductor strip 32. Conductor strips 32 and 34 extend along the entire length of shoulders 42*b* and 42*a*, and project outwardly beyond end wall 12*c* of tank 12 for connection to leads 36 and 38 (shown in FIG. 1).

Conductor strip 34 has a plurality of electrically conductive clips 44 mounted on the upper surface thereof, and spaced uniformly apart along the strip. Clips 44 provide an electrical connector to cathode elements 46, as described in more detail hereinbelow. Similarly, a plurality of electrically conductive clips 48 are mounted in spaced apart relationship along the upper surface of conductor strip 32, to electrically connect anode elements 50.

A series of vertically oriented narrow width channels 52 are mounted on the interior face of tank rearward wall 12*b*, in vertical alignment with clips 48. A series of identical channels 52' (not shown in FIG. 2) are also mounted on the interior face of tank forward wall 12*a*, directly opposite channels 52, to receive and retain anode elements 50 in a vertical orientation. A plurality of wide width channels 54 are mounted parallel and spaced in between narrow channels 52 on rearward wall 12*b*, with corresponding channels 54' (not shown in FIG. 2) mounted on forward wall 12*a*, to receive and retain cathode elements 46 in vertical orientations.

Figure 3:
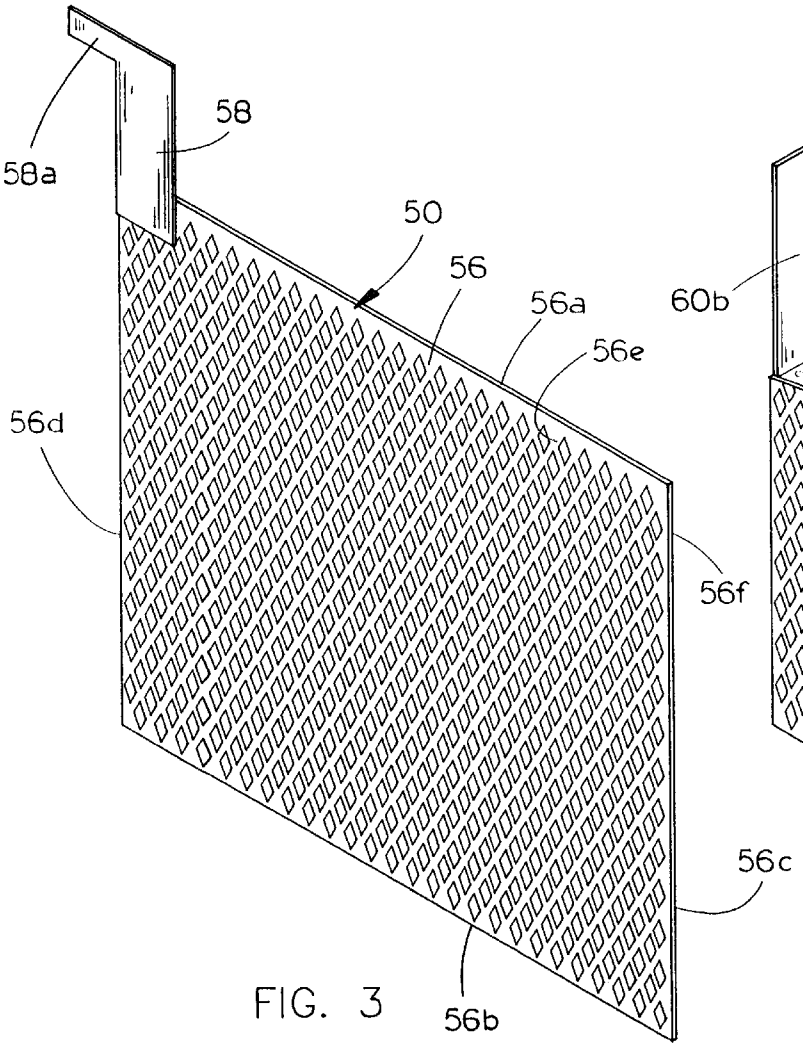
FIG. 3 is a perspective view of one anode element of the filter system.

Referring now to FIG. 3, one anode element 50 is shown in more detail. Anode element 50 includes a flat rigid sheet 56 of nickel plated diamond mesh, the mesh sheet having apertures of a size permitting the flow of waste water and the entrained heavy metal particulate therein. Sheet 56 is formed of an electrically conductive material and includes upper and lower edges 56*a* and 56*b*, forward and rearward edges 56*c* and 56*d* and opposing exterior faces 56*e* and 56*f*. An electrically conductive tab 58 is electrically connected to sheet 56 and projects upwardly beyond the upper edge thereof. Tab 58 includes a rearwardly projecting ear 58*a* which will be received in one of clips 48, to electrically connect the anode element 50 to the conductor strip 32.

Figure 4:
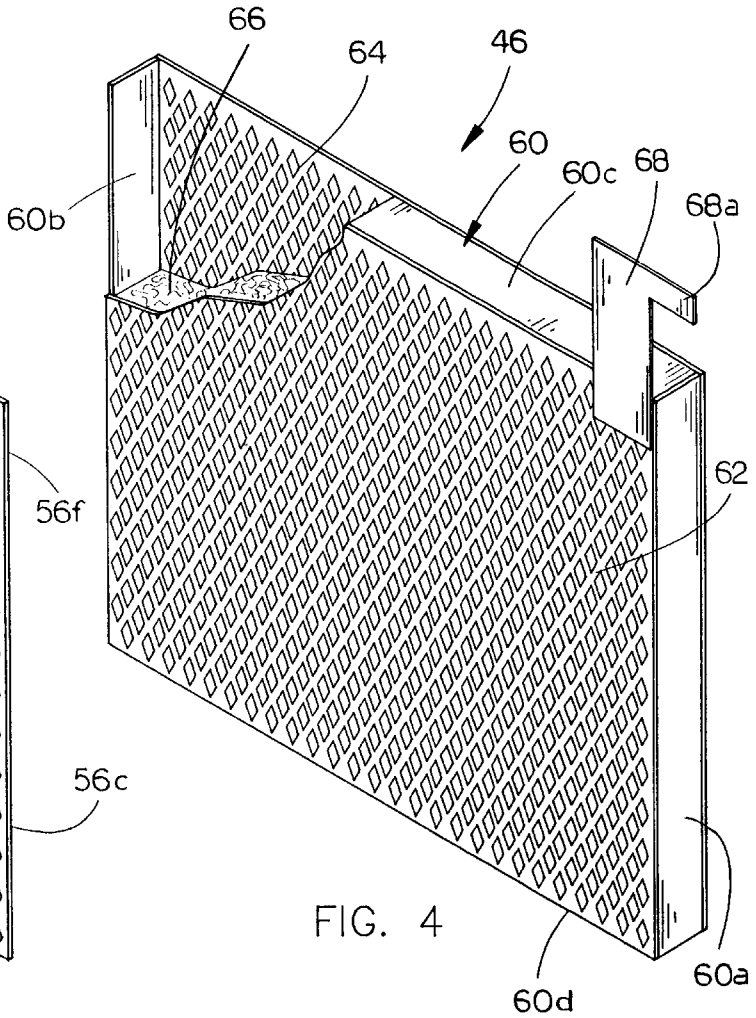
FIG. 4 is a perspective view of one cathode element of the filter system.

Referring now to FIG. 4, one cathode element 46 is shown in more detail. Cathode element 46 includes an enclosed box-like frame 60 of electrically conductive materials. Frame 60 includes forward and rearward walls 60*a* and 60*b*, upper and lower walls 60*c* and 60*d*, and parallel spaced apart panels 62 and 64, enclosing the walls to form the box. Panels 62 and 64 are preferable nickel plated diamond mesh spot welded to walls 60*a*, 60*b*, 60*c*, and 60*d*, and are therefore also electrically conductive. The interior cavity of box frame 60 is filled with shavings of electrically conductive material, such as stainless steel. Preferably, this material is waste shavings, left over from the process of cutting threads on nuts and bolts and the like. In this way, a waste material is put to yet a further beneficial use before being discarded. In addition, this waste material will help remove hazardous waste in the filter system of the present invention. Thus, the filter system is doubly beneficial to the environment, through productive use of scrap and energy savings. Shavings 66 provide an enormous amount of surface area for the collection of metal ions during the filtering process, as described in more detail hereinbelow. The apertures of the mesh of panels 62 and 64 are preferably of a size which permits the flow of waste water into and through the cathode element 46, but retains the metal shavings 66 within the box frame 60. A tab 68 is electrically connected to frame 60 and projects upwardly therefrom with an ear 58*a* projecting forwardly from the tab for receipt in one of clips 44 on conductor strip 34.

Figure 5:
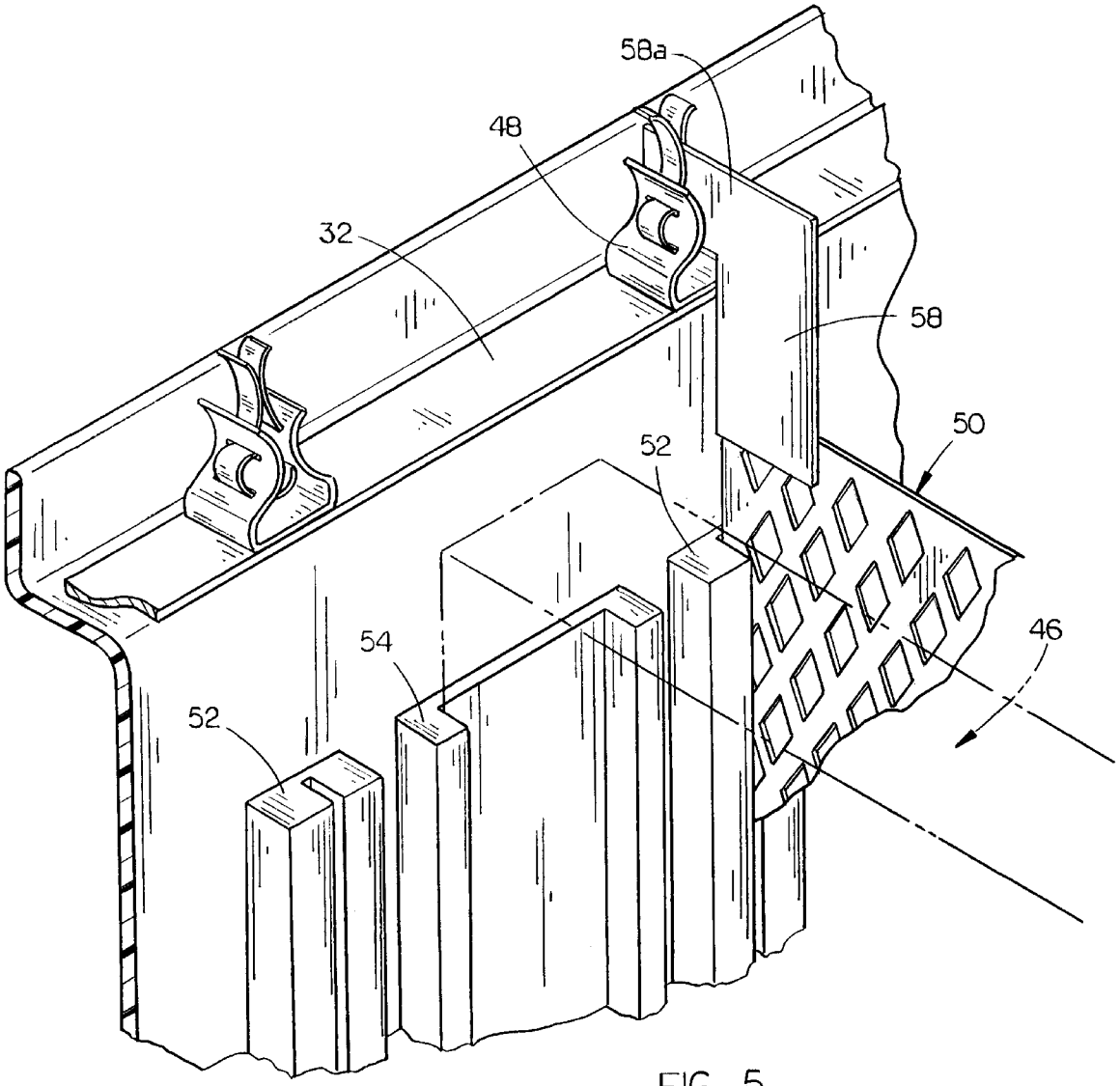
FIG. 5 is an enlarged perspective view showing the connection of one anode into the tank of the filter system.

Referring now to FIG. 5, it can be seen more clearly how narrow channels 52 form vertical guides for anode elements 50 and wide channel 54 form a vertical guide for cathode elements 46. In addition, a typical clip 48 is shown to demonstrate the slidable electrical connection of an anode 50 with clip 48 and conductor strip 32. The ear 58*a* of tab 58 will slide vertically downwardly between the legs of the clip such that the clip grips the ear 58*a* to form a secure electrical connection.

Figure 6:
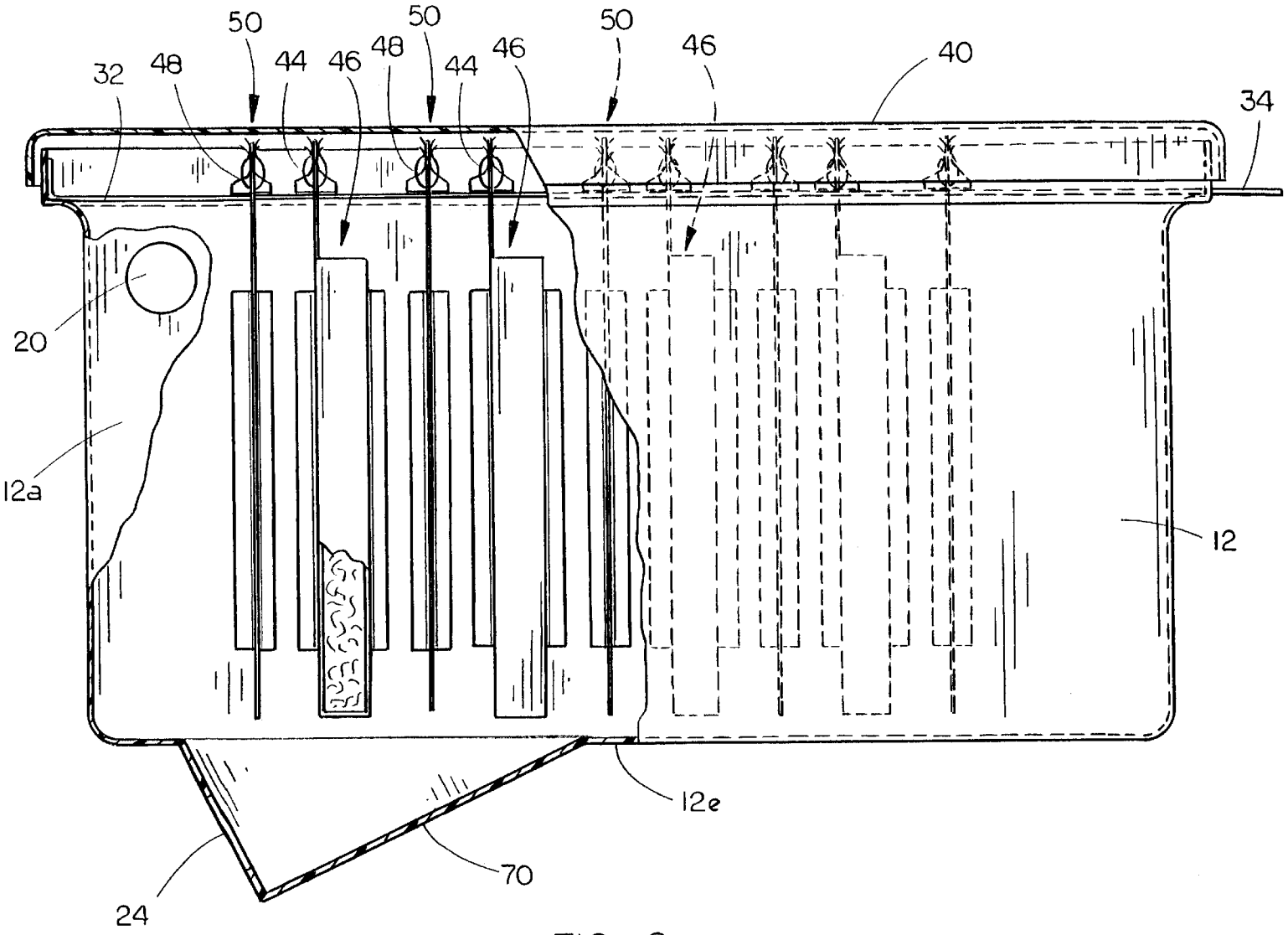
FIG. 6 is a side elevational view of the tank shown in FIG. 1, with portions shown in sectional view to display the filter system.

Referring now to FIG. 6, it can be seen that a cathode element is arranged spaced parallel between anode elements 50 to form a repeating pattern within tank 12. Because clips 44 and 48 open outwardly, any element 46 or 48 may be easily inserted and removed from the tank 12.

Inlet port 20 is preferably located in the upper portion of forward wall 12*a*, as shown in FIG. 6. A depending basin 70 projects downwardly from the bottom 12*e* of tank 12, as shown in FIGS. 2 and 6. Outlet port 24 is formed in this basin 70.

In operation, the recovery system 16 is moved to the desired location at an electroplating process site as shown in FIG. 1. Inlet conduit 18 is connected to a source of waste rinse water, and outlet conduit 22 is connected to the waste water supply line, to provide recycled clean rinse water. Power supply 26 is then activated to supply DC power to conductor strips 32 and 34 and thereby to anode and cathode elements 50 and 46, as shown in FIG. 6. As waste water is circulated through tank 12, anode elements 50 produce a positive charge on the heavy metals and particulate within the waste water. As these charged particles then pass through cathode elements 46, the negative charge attracts the positively charged particulate and holds the particulate within the metal shavings 66 of the cathode elements 46. The cleaned water than passes out the outlet port 24 for reuse as rinse water in the electroplating process.

It can be seen that individual cathode elements 46 may be quickly and simply removed and replaced by opening lid 40 and pulling upward on the particular cathode element such that it slides upwardly and out of the opposing wide channels 54. Similarly, the anode elements 50 may be cleaned and/or replaced in a similar fashion.

Whereas the invention has been shown and described in connection with the preferred embodiment thereof, many modifications, substitutions, and additions may be made which are within the intended broad scope of the appended claims.

I claim:

1. A system for filtering waste water, comprising:

a tank for holding waste water, having forward and rearward walls, opposing end walls and a bottom;

said tank including in inlet port for receiving waste water, and an outlet port for dispensing filtered water;

a first anode element suspended within the tank, for providing a positive charge to particulate within waste water in the tank;

a first cathode element suspended within the tank and spaced from the first anode, for attracting and holding positively charged particulate, to thereby remove the particulate from the water;

a DC power supply having a positive terminal electrically connected to the first anode and a negative terminal electrically connected to the first cathode;

said first anode including a sheet of electrical conductive material having a mesh of apertures of a size sufficient to permit the flow of waste water with particulate therethrough;

said anode sheet being oriented generally vertically within the tank and extending substantially between the tank forward and rearward walls and from the tank bottom to proximal upper edges of the tank walls;

said first cathode including a sheet of electrically conductive material having a mesh of apertures of a size sufficient to permit the flow of waste water with particulate therethrough;

said first cathode including a second electrically conductive mesh sheet spaced from and parallel to the cathode first mesh sheet, and further including a frame forming a box with the two mesh sheets forming two sides of the box.

said first cathode sheets being oriented parallel to the first anode sheet, and extending substantially from the tank forward wall to the rearward wall and from the tank bottom to proximal the tank wall upper edges;

and electrically conductive shavings filling the first cathode box from between the cathode sheets.

2. The filter system of claim 1, wherein said shavings are of a size greater than the apertures in the cathode mesh sheets, such that the shavings are retained between the sheets.

3. The filter system of claim 2, further comprising means for selectively, removably and independently connecting the first anode and first cathode within the tank.

4. The filter system of claim 3, wherein said means for connecting the anode and cathode within the tank includes:

a first pair of anode guides on the forward and rearward tank walls for slidably receiving the anode; and a first pair of cathode guides on the forward and rearward tank walls for slidably receiving the cathode.

5. The filter system of claim 4, further comprising a second anode element suspended within the tank, spaced from the first anode and first cathode and located such that the cathode is positioned between the first and second anodes, said second anode electrically connected to the positive terminal of the DC power supply.

6. The filter system of claim 5, further comprising a second cathode element suspended within the tank, spaced from the first cathode and located with the second anode between the first and second cathodes, said second cathode electrically connected to the negative terminal of the DC power supply.

7. The filter system of claim 6, further comprising a second cathode element suspended within the tank, spacedrom the first cathode and located with the second anode between the first and second cathodes, said second cathode electrically connected to the negative terminal of the DC power supply.

8. A system for recovering heavy metals from the waste water of an electroplating process, comprising:

a tank having forward and rearward walls, opposing end walls and a bottom, for receiving and filtering waste water;

an inlet port formed proximal an upper edge of one of said walls connected to a source of waste water;

an outlet port formed in the tank and spaced from the inlet port connected to an outlet conduit, for dispensing filtered water from which heavy metals have been recovered;

a plurality of anodes disposed within the tank and uniformly spaced apart from one end of the tank to the other end;

a plurality of cathodes disposed within the tank and uniformly spaced among the anodes to form a repeating anode/cathode pattern within the tank; and a DC power supply having a positive terminal connected to each of the anodes and a negative terminal connected to each of the cathodes;

said anodes each including a planar sheet of electrically conductive material having a mesh of apertures therethrough, said sheets arranged parallel to one another and extending across substantially the entire depth and width of the tank, the depth measured from the wall upper edges to the bottom and the width measured from the forward wall to the rearward wall;

said cathodes each including an enclosed box having a pair of spaced-apart panels formed of generally planar sheets of electrically conductive material with a mesh of apertures therethrough, the box filled with shavings of electrically conductive material, and the panels arranged parallel to the anode sheets and extending across substantially the entire width and depth of the tank.

9. The recovery system of claim 8, further comprising:

means on the tank forward and rearward walls for slidably receiving and retaining the anodes in generally vertical planes;

means on the tank forward and rearward walls for slidably receiving and retaining the cathodes in generally vertical planes;

a first conductor strip mounted along the upper edge of the tank rearward wall and electrically connected to the DC power supply positive terminal;

a plurality of electrically conductive clips mounted on the first strip for selectively, removably, electrically connecting each anode to the strip when each anode is positioned in the receiving and retaining means;

a second conductor strip mounted along the upper edge of the tank forward wall and electrically connected to the DC power supply negative terminal; and a plurality of electrically conductive clips mounted on the second strip for selectively, removably, electrically connecting each cathode to the second strip when each cathode is positioned in the receiving and retaining means.

* * * * *